United States Patent [19]

Coddens

[11] Patent Number: 4,922,658

[45] Date of Patent: May 8, 1990

[54] SLIDING STORM DOOR OR WINDOW ASSEMBLY

[75] Inventor: Donald L. Coddens, South Bend, Ind.

[73] Assignee: Therm-O-Loc, Inc., South Bend, Ind.

[21] Appl. No.: 9,189

[22] Filed: Jan. 30, 1987

Related U.S. Application Data

[63] Continuation-in-part of Ser. No. 851,127, Apr. 11, 1986, Pat. No. 4,667,441.

[51] Int. Cl.[5] ..... E05D 15/06

[52] U.S. Cl. ..... 49/458; 49/485; 49/478

[58] Field of Search ..... 49/404, 428, 501, 504, 49/425, 485, 458, 367; 52/630

[56] References Cited

U.S. PATENT DOCUMENTS

| | | | |
|---|---|---|---|
| 4,227,346 | 10/1980 | Kubik | 49/501 |
| 4,351,131 | 9/1982 | Kubik | 49/504 |
| 4,370,830 | 2/1983 | Schaefer et al. | 49/504 |
| 4,667,441 | 5/1987 | Coddens | 49/404 |
| 4,815,246 | 3/1989 | Haas | 49/501 |

*Primary Examiner*—Joseph Falk
*Assistant Examiner*—Gerald A. Anderson
*Attorney, Agent, or Firm*—James D. Hall

[57] ABSTRACT

A sliding door or window assembly which includes peripheral frames each encasing a glazing panel. Each frame is constructed of lightweight non-metallic material and includes rigid strengthening inserts fitted into the frame vertical members.

6 Claims, 6 Drawing Sheets

SLIDING STORM DOOR OR WINDOW ASSEMBLY

CROSS-REFERENCE TO RELATED APPLICATIONS

This application is a continuation-in-part of co-pending application Ser. No. 851,127, filed Apr. 11, 1986, now U.S. Pat. No. 4,667,441.

SUMMARY OF THE INVENTION

This invention relates to a door or window assembly and has special but not limited application to a sliding glass storm door or window.

The sliding door or window of this invention includes a sash formed of lightweight non-metallic material such as rigid plastic. The sash includes rigid inserts fitted in the vertical frame members to strengthen the sash while maintaining its excellent insulative properties. A magnetic strip weather seal can be provided between the sash and its overlapped assembly components.

Accordingly, it is an object of this invention to provide for an improved sliding glass door or window.

Another object of this invention is to provide for a lightweight sliding glass storm door or window which is durable and strong.

Another object of this invention is to provide for a lightweight sliding glass door or window which maintains excellent insulative properties and is economical to produce and maintain.

Still another object of this invention is to provide a sliding storm door or window assembly having magnetic weather stripping.

Other objects of this invention will become apparent upon a reading of the following description.

DESCRIPTION OF THE PREFERRED EMBODIMENTS

The preferred embodiments herein described are not intended to be exhaustive or to limit the invention to the precise forms disclosed. They are chosen and described to explain the principles of the invention and its application and practical use to thereby enable others skilled in the art to utilize the invention.

Figure 1:
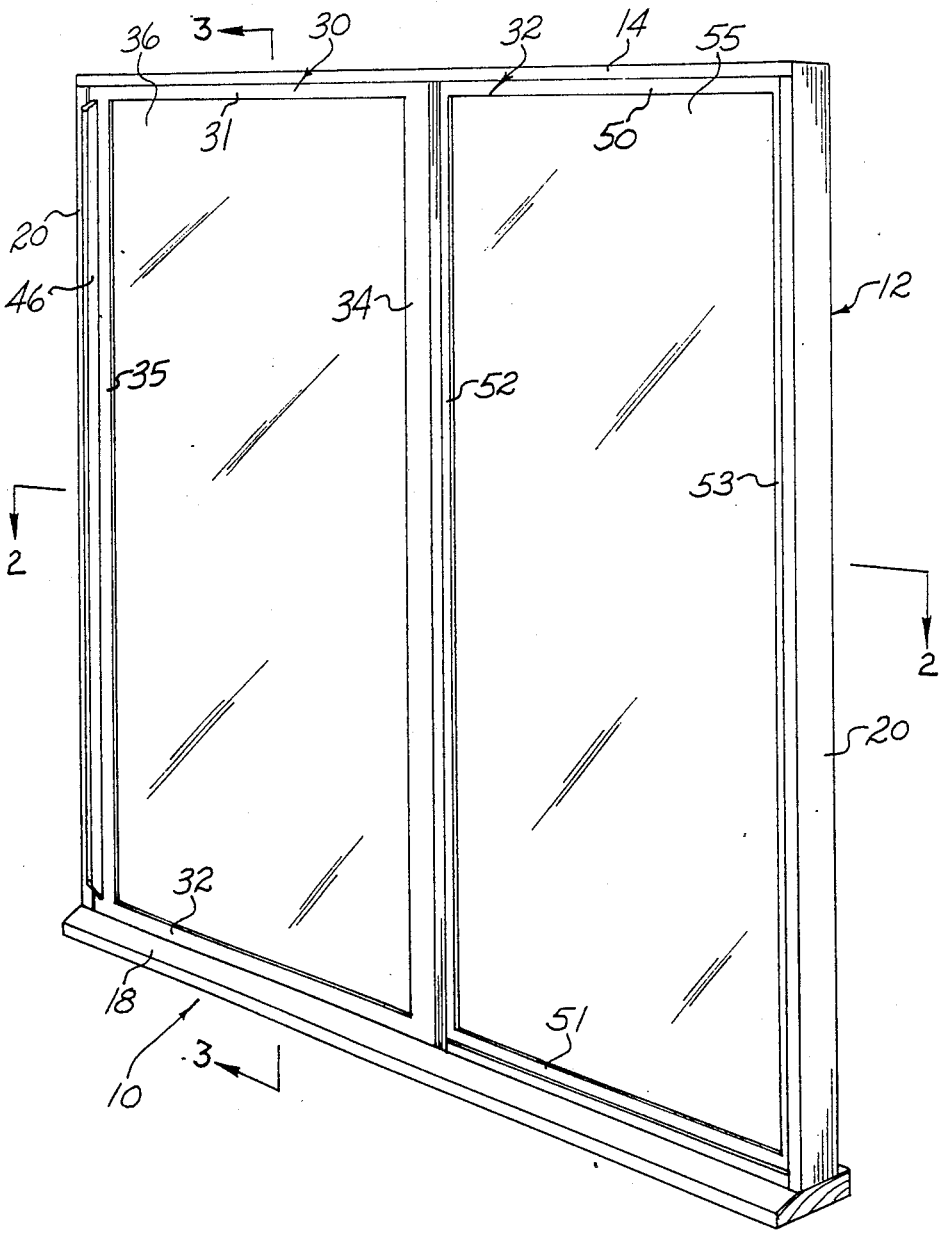
FIG. 1 is a perspective view of the door assembly.
Figure 2:
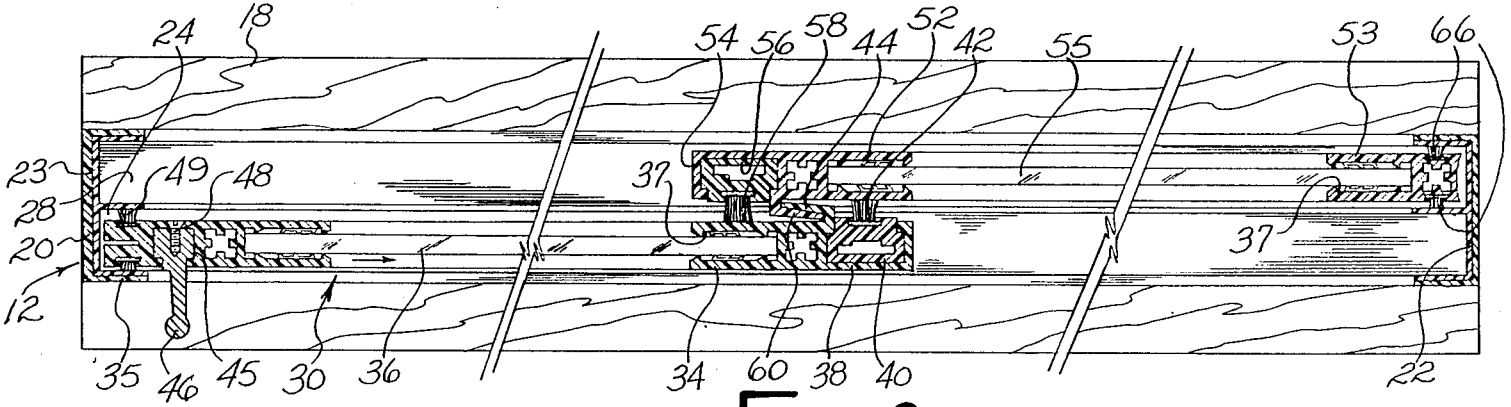
FIG. 2 is a fragmentary cross-sectional view taken along line 2—2 of FIG. 1.
Figure 3:
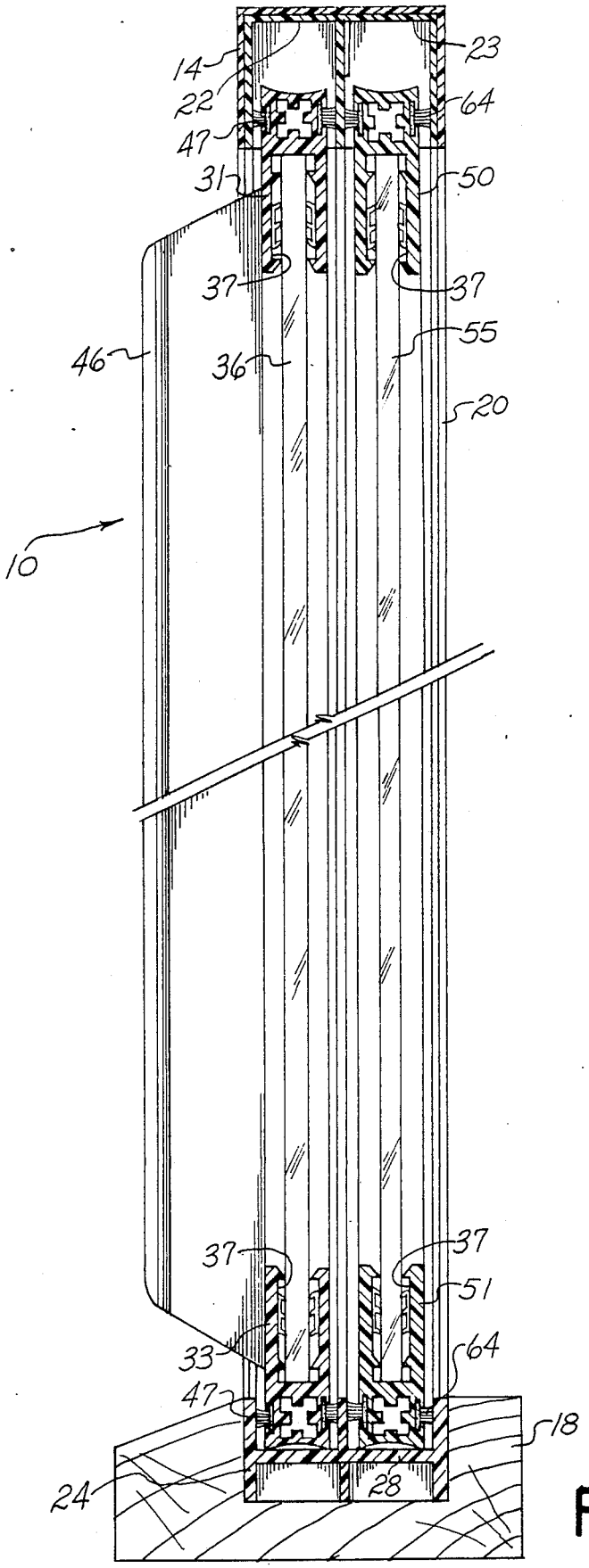
FIG. 3 is a fragmentary vertical sectional view taken along line 3—3 of FIG. 1.

FIGS. 1–3 depict a sliding glass door assembly 10 constructed according to the principles of this invention. Assembly 10 includes an outer rectangular frame 12 formed of a header 14, a threshold 18, and side members or jambs 20. Frame 12 is adapted to be fitted into an accommodating wall opening. Header 14 and jambs 20 are each generally U-shaped and include adjacent channel parts 22, 23. Threshold 18 includes, as shown in FIG. 3, a channel part 24 which accommodates movement of a sliding door 30, and an adjacent raised channel part 28 which accommodates a normally stationary door 32.

Sliding door 30 includes an exterior frame or sash which includes horizontal sash members 31 and 33 and vertical sash members 34 and 35. Lower sash member 33 is positioned in channel part 24 and is adapted for sliding movement within the channel part. Channel part 24 may include an integral passageway 26 to catch dirt or other impurities from door 30. A glazing panel 36 is secured between sash members 31, 33–35 by being fitted into retainer channels 37 as shown in FIGS. 2 and 3. Sash members 31, 33–35 are preferably formed of lightweight generally thin-walled, shape-returning, non-metallic material such as ABS plastic. Sash member 34 also includes a rear opening C-shaped channel 38 into which a rigid vertical insert 40 formed of a material such as rigid plastic or metal is fitted. A weatherstrip element 42 of felt or the like is carried by insert 40 and protrudes outwardly toward door 32 as seen in FIG. 2. Sash member 34 further includes a vertically extending lip 44 which protrudes outwardly toward door 32 and is turned in the direction of sash member 35. Vertical sash member 35 includes a front opening C-shaped channel 45 into which a rigid vertical insert 46 of a material like insert 40 is inserted. Insert 46 is handle-shaped and may be further secured to sash member 35 by screws 48. Door horizontal sash members 31 and 33 of door 30 include felt weatherstrip elements 47 which contact channel part 22, 24. Vertical frame member 35 includes oppositely extending weatherstrip elements 49.

Door 32 includes an exterior frame similar to door 30, having horizontal sash members 50 and 41 and vertical sash members 52 and 53 formed of lightweight non-metallic material such as ABS plastic. A glazing panel 55 is secured between sash members 50–53. Sash member 52 also includes a front opening C-shaped channel 54 into which a rigid vertical insert 56 formed of rigid plastic or metal is fitted. A weatherstrip element 58 of felt or the like is carried by insert 56 and contacts sliding door frame 30. Sash member 52 further includes a vertically extending lip 60 which protrudes outwardly towards door 30 and is turned in the direction of sash member 53 so as to overlap lip 44 of door 50 when the doors are closed. Horizontal sash members 50, 51 include weatherstrip elements 62, 64 which contact channel part 23, and vertical sash member 53 includes oppositely-extending weatherstrip elements 66. Sash member 53, due to its fixed position within supporting channel 23 of jamb 20, need no rigid insert for support.

Figure 4:
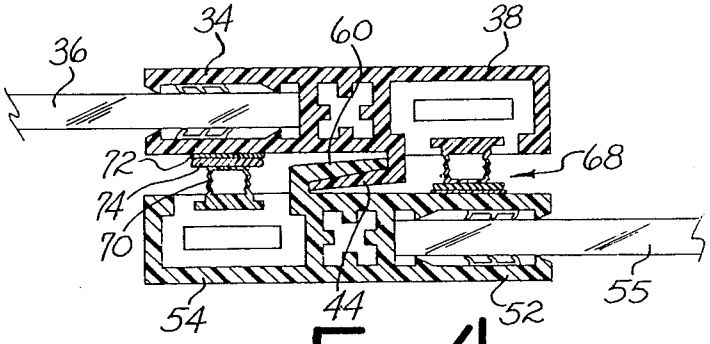
FIG. 4 is a fragmentary cross-sectional view which depicts an alternative weatherstripping for the door.

FIG. 4 depicts an alternative type of weatherstrip element 68 which includes a flexible bellows-like strip 70 secured in vertical inserts 40, 56. A magnet overlay 74 is carried by strip 70. A ferrous metallic strip 72 is secured to door sash members 35 and 52. As door 30 is closed, magnetic overlay 74 slides over strip 72 and adheres to the strip to form the weather seal. The flexible strip 72 allows for good sealing contact with magnetic overlay 74.

Figure 5:
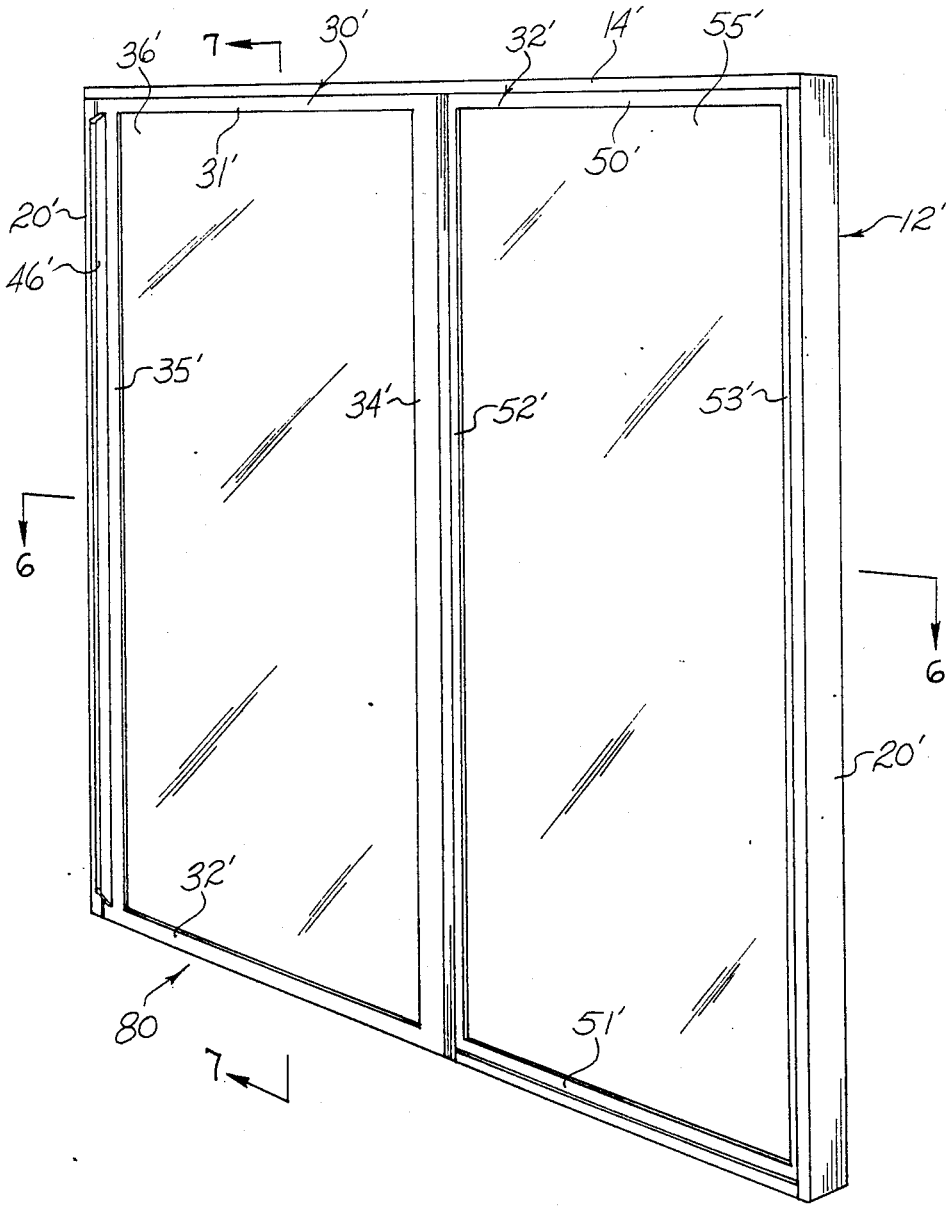
FIG. 5 is a perspective view of the window assembly.
Figure 8:
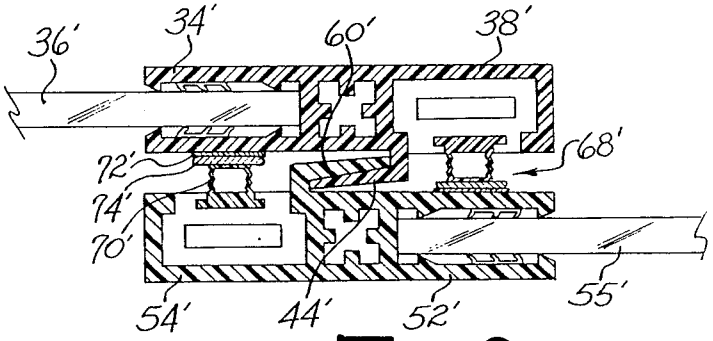
FIG. 8 is a fragmentary cross-sectional view which depicts an alternative weatherstripping for the window.
Figure 6:
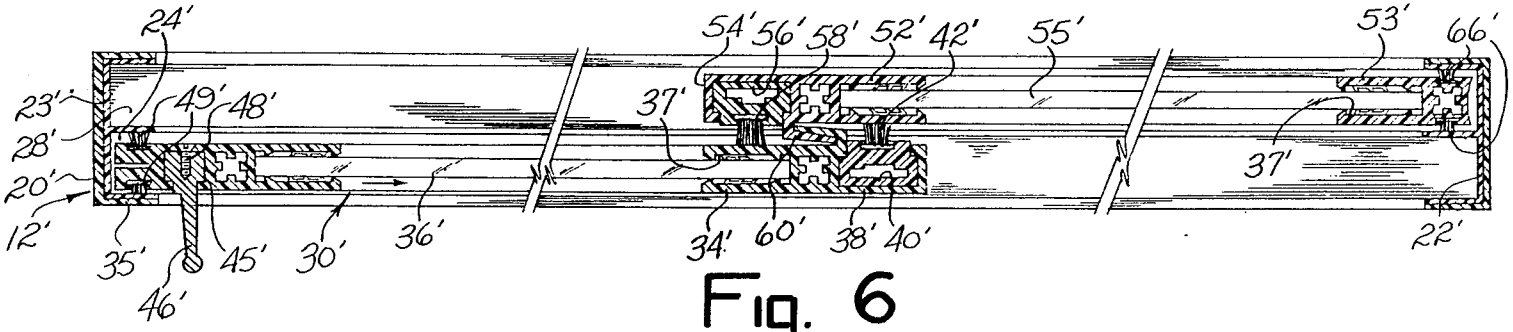
FIG. 6 is a fragmentary cross-sectional view taken along line 6—6 of FIG. 5.
Figure 7:
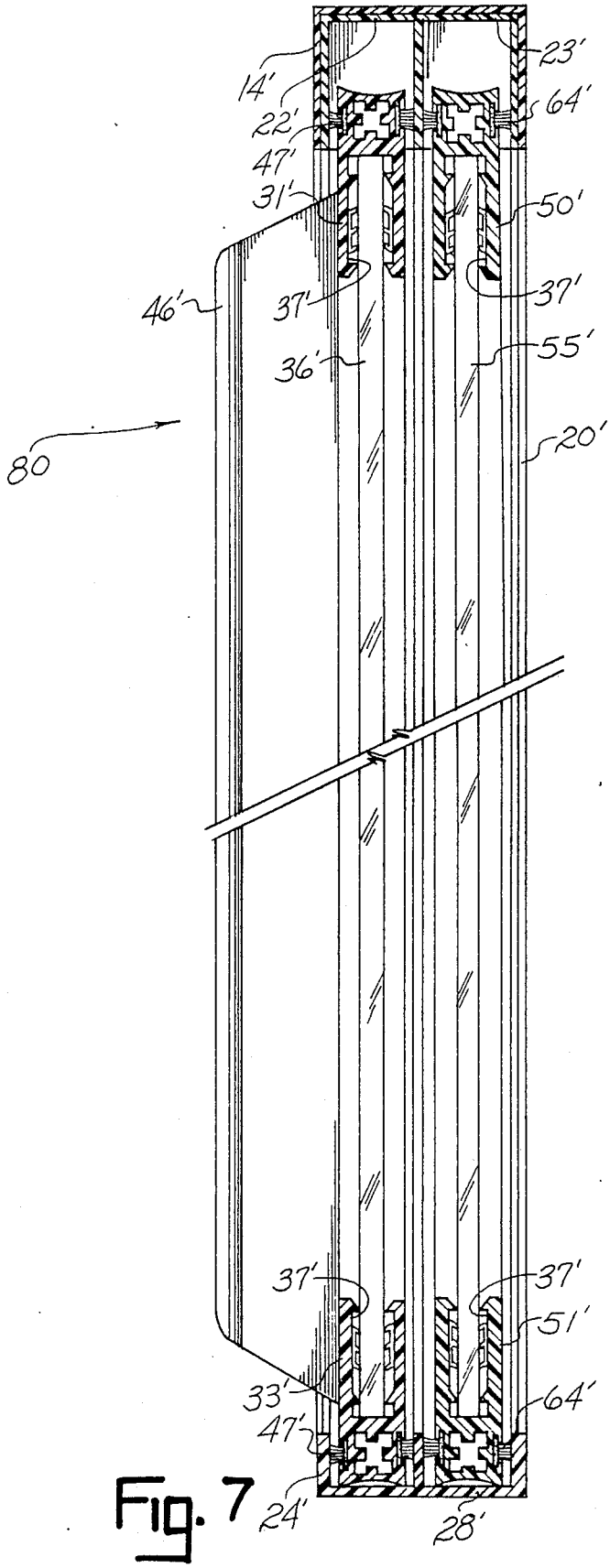
FIG. 7 is a fragmentary vertical-sectional view taken along line 7—7 of FIG. 5.

FIGS. 5–7 depict a sliding glass window assembly 80 constructed according to the principles of the invention. Window assembly 80 includes an outer rectangular frame 12' formed of a header 14' and side members or jambs 20'. Frame 12' is adapted to be fitted into an accommodating wall opening. All other parts of window assembly 80 are identical to the above-identified parts in door assembly 10, and are identified in FIGS. 5–8 by identical numbers followed by a ′ marking, as will not be described further in this application.

It is understood that the above description does not limit the invention to above-given details, but may be modified within the scope of the appended claims. One such modification would be a fixed, non-sliding window assembly.

I claim:

1. In a window assembly including a four-sided frame having first and second adjacent lower channel members, a first window having a sash located within said first channel member, and a second window having a sash slidably located within said second channel member, each first and second sash enclosing a glazing panel, the improvement wherein each first and second sash is formed of a lightweight material and includes interconnected horizontal and vertical sash members, at least one of said vertical sash members including a channel part, and a rigid insert fitted within said C-shaped channel part substantially filling the space provided thereby, said insert constituting means for stiffening and strengthening each sash.

2. The sliding window assembly of claim 1 wherein said lightweight material is plastic.

3. The sliding window assembly of claim 1 and weatherstripping means attached to said insert and extending outwardly of said channel part for insulating said assembly from the weather elements.

4. The sliding storm window assembly of claim 1 and magnetic means carried by one of said first and second windows, means carried by the other of said first and second window for mating with said magnet means to insulate said assembly.

5. The sliding window assembly of claim 4 wherein said magnet means includes biasing means connected to said one first and second windows and extending towards the other window, a magnet connected to said biasing means facing said other window, said mating means including a metallic strip fastened to said other window, said biasing means for accommodating movement of said magnet across said metallic strip as said one window is slid into a closed position.

6. The sliding window assembly of claim 1 wherein said channel part is of an open sided configuration receiving said rigid insert.

* * * * *